US005149098A

United States Patent [19]

Bianchi

[11] Patent Number: 5,149,098

[45] Date of Patent: Sep. 22, 1992

[54] JIGSAW PUZZLE GAME BOARD HAVING CORRESPONDING INDICIA

[76] Inventor: William J. Bianchi, 10935 S. Fulton Wells, Santa Fe Springs, Calif. 90670

[21] Appl. No.: 725,658

[22] Filed: Jul. 3, 1991

Related U.S. Application Data

[63] Continuation of Ser. No. 467,902, Jan. 22, 1990, Pat. No. 5,062,637.

[51] Int. Cl.[5] ..... A63F 9/10

[52] U.S. Cl. ..... 273/157 R; 273/276; 434/406

[58] Field of Search ..... 273/153 R, 156, 157 R, 273/276, 160; 434/84, 171, 172, 208, 406

[56] References Cited

U.S. PATENT DOCUMENTS

| | | | |
|---|---|---|---|
| 760,384 | 5/1904 | Disterich | 273/157 R |
| 1,480,458 | 1/1924 | Mershon | 273/157 R |
| 3,242,594 | 10/1963 | Smith | 273/157 R |
| 3,558,136 | 1/1971 | McFarland | 273/157 R |
| 3,779,558 | 12/1973 | Moreau | 273/157 R |
| 4,838,551 | 6/1989 | Volpert | 273/157 R |

FOREIGN PATENT DOCUMENTS

| | | | |
|---|---|---|---|
| 19440/34 | 9/1934 | Australia . | |
| 0553798 | 6/1943 | United Kingdom | 273/157 R |

*Primary Examiner*—Theatrice Brown
*Assistant Examiner*—William M. Pierce
*Attorney, Agent, or Firm*—Lyon & Lyon

[57] ABSTRACT

There is disclosed herein a game using jigsaw puzzle like game boards but wherein each game piece in the form of a jigsaw puzzle piece and the underlying board both have matching letter and number identifications facilitating locating where the game piece is to be placed. Certain game pieces have a unique indicia, such as the word "Scramble" which, after being placed on a board, results in the game boards of all players being shifted one player position. The game boards are like jigsaw puzzles with borders to retain the game pieces on the board. Each player has a board, and all game pieces are piled on the playing table. The first player selects a number of game pieces, such as ten, and places those matching his board on his board, and those not matching are returned to the pile. The first player to complete a puzzle is the winner.

6 Claims, 1 Drawing Sheet

JIGSAW PUZZLE GAME BOARD HAVING CORRESPONDING INDICIA

This is a continuation of co-pending application Ser. No. 07/467,902, filed on Jan. 22, 1990, now U.S. Pat. No. 5,062,637.

BACKGROUND OF THE INVENTION

The present invention relates to games of the board type, and more particularly to a game using jigsaw puzzles.

Various forms of board games have been devised over the years. Also, numerous form of jigsaw puzzles have been created. Board games are games which usually are played by two or more people. On the other hand, a jigsaw puzzle is not a game as such, but is a puzzle with pieces which are put together by a single person, although others can help in placing the pieces. Both board games and jigsaw puzzles present challenges to those who play such games, and those who put together such puzzles. They vary from the very simple to the incredibly complex. Board games and jigsaw puzzles both can provide minutes and hours of fun, enjoyment and intrigue, but their attributes and capabilities have not been combined into a useful and fun jigsaw puzzle and board game.

Accordingly, it is a principal object of the present invention to provide a new jigsaw puzzle game.

Another object of this invention is to provide a jigsaw board game which may comprise from only a few playing pieces to as many as a large number of playing pieces.

A further object is to provide a new game employing modified jigsaw puzzles.

BRIEF DESCRIPTION OF THE DRAWINGS

These and other objects and features of the present invention will become better understood through a consideration of the following description taken in conjunction with the drawings in which.

In accordance with a preferred embodiment of the present invention, a game board in the form of a jigsaw puzzle with borders surrounding the playing area is provided, along with removable pieces which are formed like in a conventional jigsaw puzzle. The bottom side of each of these pieces has an identification as does the area of the game board base where each piece fits. One or more of the removable pieces has, on its bottom, a particular indicia, for example the word "Scramble." Two or more of the game boards are provided respectively for two or more players, and the game proceeds according to the instructions and rules which are detailed subsequently.

DETAILED DESCRIPTION

Figure 1:
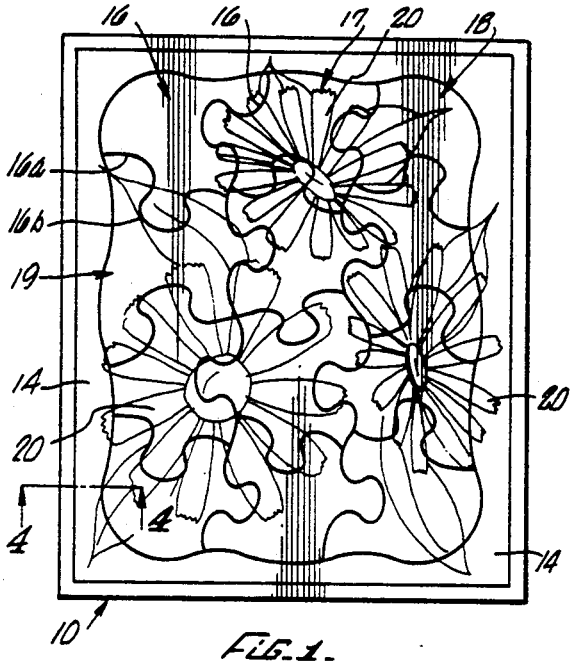
FIG. 1 is a top plan view of a jigsaw puzzle game according to the present invention.
Figure 5:
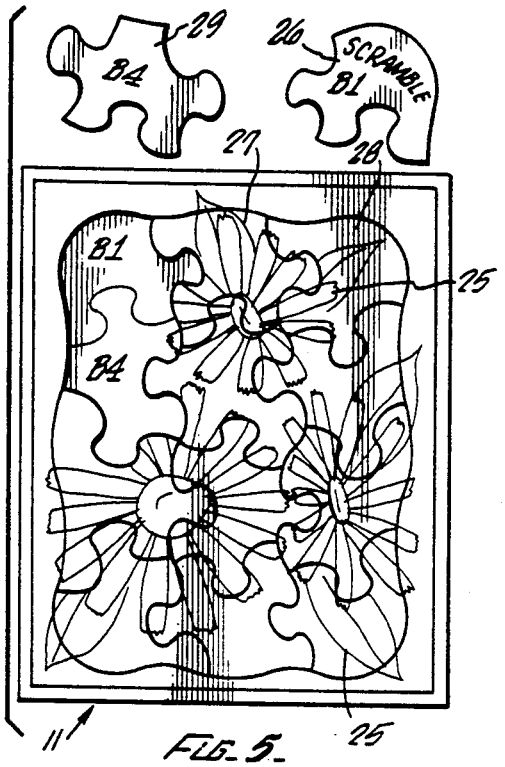
FIG. 5 is a view of a second jigsaw puzzle game and removed pieces similar to that of FIGS. 1–4 and for use with the latter in playing the present game.
Figure 2:
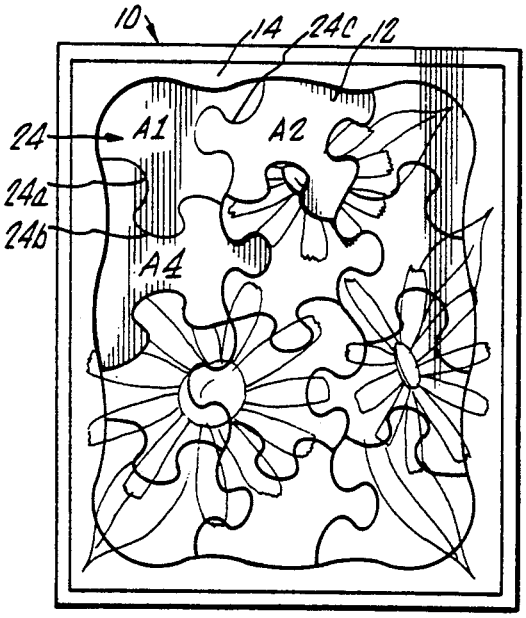
FIG. 2 is a view similar to FIG. 1 but with several of the game pieces removed.
Figure 3:
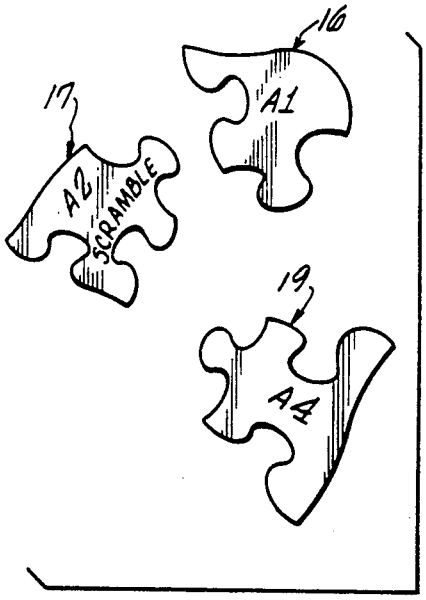
FIG. 3 is a view of the underside of the removed game pieces.
Figure 4:
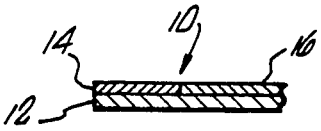
FIG. 4 is a cross-sectional view taken along a line 4—4 of FIG. 1.

Turning now to the drawings, a pair of jigsaw puzzle game boards 10 and 11 are shown in respective FIGS. 1 and 5. FIGS. 2 through 4 provide further details of the game board 10 of FIG. 1. The two game boards can be similar but preferably are not identical.

Turning now to the construction of the game board 10 shown in FIGS. 1 through 4, the same includes a base or backing 12 (note the cross-sectional view in FIG. 4), and a frame or border 14 secured thereto in a conventional manner as by an adhesive (not shown), thereby forming a tray-type construction for holding the game pieces (which are in the form of jigsaw puzzles pieces) on and within the tray. The edge 14 thus not only forms a decorative border but also prevents the game pieces from sliding off of the composite game board.

The game board further comprises a plurality of individual game pieces 16, 17, 18, etc. which are separated along mating edges such as 16*a*, 16*b* and 16*c* of FIG. 1. Suitable surface indicia, and exemplified generally by flowers 20, which may take any of many forms such as maps, cartoon characters, pictures and the like are provided on the upper or top surface of the game pieces 16, 17, etc. The thus-far described game board is like a typical jigsaw puzzle.

The game board has additional new constructional features and interrelationships which will now be described. Each of the game pieces 16, 17, etc. has a specific identification provided on the bottom thereof which (1) identifies its game board, and (2) identifies its specific position on the game board, thereby making it easy to locate and place each game piece on the game board. FIG. 3 illustrates three of the game pieces 16, 17 and 18 which have been removed from the game board as shown in FIG. 2. The underside of the game pieces 16, 17 and 18 in FIG. 3 include the identifications "A1" "A2" and "A4," the letter A" standing for game board A and the number standing for number and position of the piece on that board. The upper surface 24 of the base 12 of the game board 10 as seen in FIG. 2 has like identifications thereon corresponding to the removed pieces. Thus, as seen in FIG. 2, the identifications seen on the base 12 are "A1," "A2," and "A4." In addition, the base 12 has lines (e.g., 24*a*, 24*b*, 24*c*, etc.) drawn or printed thereon the same as the outline of the respective game pieces. These lines, and the identifications (A1, A2, etc.) facilitate finding the location of and positioning of the game pieces.

The identifications on the pieces and on the base 12 of the game board are provided, contrary to the normal jigsaw puzzle, to facilitate locating the game piece on the board.

The respective game pieces A1, A2 and A4 of FIG. 3 fit in the locations A1, A2 and A4 so identified in FIG. 2. The remaining pieces and base location have like identifications (A3, and A5–A12, not seen, for the remaining pieces of the twelve piece game. In addition, one or more, and preferably three, of the game pieces on the underside has an additional indicia, such as in the present case the term "Scramble" for reasons to be discussed subsequently. This indicia is not placed on the base 12.

While the physical construction of the game board is like that of a conventional jigsaw puzzle, particular identifications and/or indicia are provided on the bottom of each and every game piece, and similar identifications are provided on the underlying base 12 of each game piece and, further, several of the game pieces have the particular added indicia, such as the word "Scramble" as noted.

The game board 11 shown in FIG. 5 is like that of FIG. 1, but preferably has different artwork 25 on the surface of the game pieces to distinguish the two game boards and, additionally has a different identification (e.g., "B") to indicate that it is a different game board. In this regard, the game pieces, identified as 26, 27, 28, 29, etc. use the letter "B" in the identification of the game pieces and areas of the base 12 to indicate that this is Game B.

Additional game boards can be provided, depending on the number of players, with each player having one game board. The game boards and game pieces as described are used and interrelated in the playing of the present game in the manner set forth below.

Each player of the game must have one complete puzzle like that shown in FIG. 1 or FIG. 5. Preferably, each puzzle has the same number of pieces. Any number of players from two on can compete.

Play begins with each player emptying all of the game pieces from his puzzle, picture side up, in the center of the playing table. The pieces are then scrambled (mixed) and any one or more players can scramble and mix the pieces. Each player picks one piece, preferably with eyes closed, from the pile to select the order of play. The players then show the bottom side of the puzzle piece selected, and the lowest number is entitled to be the first player, and so on. The pieces selected are returned to the pile.

The first player so selected then closes his eyes and picks ten pieces from the pile. Only the first player makes this selection thus far. Once the ten pieces are selected and placed bottom side up, the identifications on the bottom of the pieces are checked, and any pieces not matching that player's puzzle (the first player in this case) are returned to the pile and scrambled. That is, with the puzzle A of FIG. 1 and the puzzle B of FIG. 5, if the first player has the "A" puzzle of FIG. 1 and selects some "B" pieces, the "B" pieces are returned to the pile; only the "A" pieces are kept by this first player who has the A puzzle.

The remaining pieces selected by the first player (the "A" game pieces in this case) are placed on the board in the usual manner of filling in a jigsaw puzzle. In the event there is a game piece labelled "Scramble" like the "A2" piece in FIG. 3, this piece also is placed in the game board; however, this piece has a particular significance. When the "Scramble" piece has been selected from the pile and placed in the game board (and the remaining pieces picked on that turn for that game board are placed in the game board), then the game board is moved or passed to the player to the left (and, likewise, the other players' boards are moved to the player to the left). If, per chance, this first player picks more than one "Scramble" piece, then the game boards will be moved the number of positions to the left corresponding to the number of "Scramble" pieces picked in that turn. For example, if the first player picked and played two "scramble" pieces, then the puzzle (Puzzle A in this case) would move to the second player to the left, with the other players' puzzles likewise moving two positions. In the case of only two players with Puzzles A and B of FIGS. 1 and 5, the first player would receive his puzzle back (it would move to the second player who had Puzzle B, and then move back to the first player).

Once the first player has completed putting pieces in his puzzle, and his and the other puzzles have moved the one or more player positions as indicated by the number of "Scramble" pieces, then the second player, with his eyes closed, selects ten pieces from the pile on the table. Play continues now by this player as previously described. A score sheet, as will be described subsequently, may be kept to determine what players have contributed more or less to the completion of a game. However, the first player to complete a puzzle, any puzzle he happens to be working on regardless of whether or not it is the one he started off with, is the winner of the game.

There are several additional rules which increase interest in the present game. When a player picks his ten pieces from the pile on the table, he must do so and not peek while selecting the pieces. If the player peeks while picking pieces, the selected pieces are returned to the pile, and that player looses his turn. The pieces in the pile may be mixed or "Scrambled" by any player at any time, even while pieces are being picked, to facilitate randomness of the pieces picked. Although the number of "Scramble" pieces will vary with the number of pieces within a given puzzle, typically two to three such pieces are provided.

While the twelve-piece puzzle game boards shown in FIGS. 1 and 5 are quite suitable for a child's game, typically game boards with more pieces, such as thirty to fifty pieces, generally are preferred.

The following chart provides an example of a game with four players and four respectively different puzzles. The typical game time is approximately forty-five minutes, and players may range in age from about 5 years to 100 years old.

| Game No. 1 | | | | | |
|---|---|---|---|---|---|
| Player 1 - Puzzle A | | | Player 2 - Puzzle B | | |
| Pick 10, Keep | Scramble Pieces | Winner | Pick 10, Keep | Scramble Pieces | Winner |
| 4 | 0 | | 5 | 1 | |
| 2 | 1 | | 1 | 0 | |
| 6 | 0 | | 4 | 2 | |
| 4 | 1 | | 4 | 0 | |
| 2 | 0 | | 3 | 0 | |
| 6 | 0 | | 6 | 0 | |
| 3 | 0 | | 6 | 0 | |
| 29 | 2 | | 29 | 3 | |
| Player 3 - Puzzle C | | | Player 4 - Puzzle D | | |
| Pick 10, Keep | Scramble Pieces | Winner | Pick 10, Keep | Scramble Pieces | Winner |
| 5 | 1 | | 3 | 1 | |
| 7 | 0 | | 4 | 0 | |
| 3 | 0 | | 6 | 1 | |
| 4 | 0 | | 7 | 0 | |
| 6 | 2 | | 4 | 0 | |
| 2 | 0 | | 2 | 0 | |
| 4 | 1 | | 2 | 1 | |
| 31 | 4 | | 28 | 3 | |

In the example given, each puzzle can have thirty pieces, three of which have the "Scramble" indicia on the bottom. The game boards are identified as "Puzzle A," "Puzzle, B," "Puzzle C" and "Puzzle D," with the bottom of the game pieces and top surface of the boards bearing the matching letters and numbers as indicated in the Figures and as explained previously. Once the order of play has been decided, the first player picks ten pieces with his eyes closed from the pile of 120 pieces. The pieces picked for another's puzzle are returned to the pile and scrambled for the next player. In the chart which follows, it can be seen (Column 1) that Player 1 picked ten pieces, only four of which were for his puzzle (with the remaining six being returned). The first player received zero Scramble pieces (Column 2) on the first turn. Player 2 picked ten pieces, five of which were for his puzzle, and one of which was a Scramble piece (Columns 1 and 2). The play continues with players 3 and 4. On the second turn for Player No. 1, only two of the picked ten pieces were for his puzzle, but one was a "Scramble" piece as shown in Columns 1 and 2 under Player A—Puzzle A. The game is continued as illustrated. While the chart is in the form of score sheets, they are not necessary as part of the game, but they are helpful for keeping track of how well a player may, through his "extra sensory perception" or other ability, be able to pick high numbers of pieces of his particular puzzle.

The game is exciting and provides untiring fun, and is a game of individual ingenuity.

It will be apparent that the game boards can be manufactured in the form of jigsaw puzzles, but with the added letter and number identifications on the game pieces and on the base 12 of the game board, and along with the "Scramble" indicia. On the other hand, standard puzzles can be modified by the addition of these fications and indicia to create and play the present game. Standard jigsaw puzzles thus can be provided with the letter/number identifications and indicia in the form of self-adhesive labels to be applied to the bottom of the game pieces and to the top surface of the base of the game board, and the outlines 24*a*, 24*b*, etc. of the game pieces can be added (e.g., in ink) on the base 12.

While embodiments of the present invention have been shown and described, various modifications may be made without departing from the scope of the present invention, and all such modifications and equivalents are intended to be covered.

What is claimed is:

1. A board game comprising a game board having a base and frame around the base, and a plurality of game pieces in the form of jigsaw puzzle pieces which substantially fill the base, the frame being disposed around the base to hold the game pieces on the base, the improvement comprising the base having a top surface for normally supporting a plurality of jigsaw game pieces, and the base having formed thereon game piece sections over substantially the entire top surface of the base in the form of outlines of respective game pieces, and further having first game indicia in each such section, the game pieces having bottom surfaces and being shaped for mating with the outlines of respective game piece sections, and the bottom surfaces of the game pieces having like first game indicia thereon, said first game indicia comprising first indicia on a board and on each game piece for ease of associating a particular game piece with the game board and comprising a second indicia in each game piece section of the top surface of the base and on the bottom surface of each respective game piece identifying a particular game piece and location thereof on the base, and at least one of said game pieces having on the bottom surface a third unique indicia, such unique indicia when on a selected game piece and this game piece being placed in a game board causes, according to rules of play, the board to be advanced from one player to the next player.

2. A board game as in claim 1 wherein the first indicia comprises a letter for associating a particular game piece with the game board and the second indicia comprises a number identifying a respective game piece and game piece section, and said unique indicia is a word.

3. A board game comprising a game board having a base and frame around the base, and a plurality of game pieces in the form of jigsaw puzzle pieces which substantially fill the base, the frame being disposed around the base to hold the game pieces on the base, the improvement comprising the base having a top surface for normally supporting a plurality of jigsaw game pieces, and the base being capable of having formed thereon outlines of the game pieces thereby defining game piece sections over substantially the entire top surface of the base in the form of outlines of respective game pieces, and further being capable of having first game indicia in each such section, the game pieces having bottom surfaces and being shaped for mating with the outlines of respective game piece sections, and the bottom surfaces of the game pieces being capable of having like first game indicia thereon, said first game indicia comprising first indicia for identifying a particular game board and comprising a second indicia identifying ak particular game piece and location thereof on the board, and at least one of said game pieces having on the bottom surface a third unique indicia, such unique indicia when on a selected game piece and this game piece being placed in a game board causes, according to rules of play, the board to be advanced from one player to the next player.

4. A board game comprising a plurality of game boards each having a base and frame around the base, and each having a plurality of interlocking and mating game pieces in the form of jigsaw puzzle pieces which substantially fill the base, the frame being disposed around the base to hold the game pieces on the base, the improvement comprising each base having a top surface for normally supporting a plurality of jigsaw game pieces associated with that respective base, and each base having formed thereon outlines of the game pieces to be received thereby defining game piece sections over substantially the entire top surface of the base in the form of outlines of the respective game pieces, and each base further having first game indicia in each such section, the game pieces having bottom surfaces and being shaped for mating with the outlines of respective game piece sections of respective boards, and the bottom surfaces of the game pieces of a given board having like first game indicia thereon, said first game indicia comprising first indicia on a board and on each game piece for identifying a particular game board of the plurality of boards and comprising a second indicia in each game piece section of the top surface of the base and on the bottom surface of each receptive game piece identifying a particular game piece for a board and location thereof on the base, and at least one of said game pieces for each board having on the bottom surface a further and unique indicia, such unique indicia when on a selected game piece and this game piece being placed in its respective game board causes, according to rules of play, that board to be advanced from one player to the next player.

5. A board game comprising at least first (A) and second (B) game boards each having a base and frame around the base, and each having a plurality of game pieces in the form of jigsaw puzzle pieces which substantially fill the respective base, the frame being disposed around the base to hold the game pieces on the base, the improvement comprising each base of each game board having a top surface for normally supporting a plurality of jigsaw game pieces for that game board, and the base having formed thereon outlines of its respective game pieces thereby defining game piece sections over substantially the entire top surface of each base in the form of outlines of respective game pieces, and each base further having first game indicia in each such section, the game pieces for each board having bottom surfaces and being shaped for mating with the outlines of respective game piece sections of that board, and the bottom surfaces of the game pieces having like first game indicia thereon, the game pieces have top surfaces having a pattern printed thereon, said first game indicia comprising first indicia on a board and on each game piece for identifying a respective game board A or B and comprising a second indicia in each game piece section of the top surface of the respective base and on the bottom surface of each respective game piece identifying a particular game piece for the respective board and location thereof on the base, and at least one of said game pieces of each board having on the bottom surface a further and unique indicia, such unique indicia when on a selected game piece and this game piece being placed in the game board causes, according to rules of play, that board to be advanced from one player to the next player.

6. A method of forming a board game from a jigsaw puzzle having a plurality of interlocking jigsaw puzzle pieces forming an image and which comprise game pieces, and a game board wherein the game board comprises a base with a surface of normally supporting a plurality of the jigsaw game pieces, comprising the steps of forming over substantially the entire surface of the game board base game piece sections in the form of outlines of respective game pieces, providing game indicia in each such section, said game indicia comprising (1) first letter indicia for ease of associating a particular game piece with the game board and (2) second number indicia identifying the location for a particular game piece of a plurality of game pieces for that game board, providing like game indicia on the bottom of game pieces for the particular game board, forming on the bottom of at least one game piece a third unique word indicia which unique indicia, according to rules of play for the game board, causes the board to be advanced from one player to the next player, and repeating the foregoing steps for forming at least a second board game from a jigsaw puzzle and a game board.

* * * * *